US005718522A

United States Patent [19]

Kang

[11] Patent Number: 5,718,522

[45] Date of Patent: Feb. 17, 1998

[54] HEAT TRANSFER PRINTER

[75] Inventor: Dong-hwan Kang, Suwon, Rep. of Korea

[73] Assignee: Samsung Electronics Co., Ltd., Kyungki-Do, Rep. of Korea

[21] Appl. No.: 698,027

[22] Filed: Aug. 15, 1996

[30] Foreign Application Priority Data

Mar. 29, 1996 [KR] Rep. of Korea ..... 96-9185

[51] Int. Cl.[6] ..... B41J 2/325; B41J 23/00

[52] U.S. Cl. ..... 400/120.04; 347/176; 400/185

[58] Field of Search ..... 400/120.04, 120.16, 400/185, 236, 236.2; 347/176, 215

[56] References Cited

U.S. PATENT DOCUMENTS

| | | | |
|---|---|---|---|
| 2,354,166 | 7/1944 | Windham et al. | 101/483 |
| 3,855,448 | 12/1974 | Hanagata et al. | 400/120.16 |
| 4,695,850 | 9/1987 | Nubson | 400/662 |
| 5,369,422 | 11/1994 | Yoshida et al. | 400/232 |
| 5,399,031 | 3/1995 | Whritenor | 400/120.16 |

*Primary Examiner*—Edgar S. Burr
*Assistant Examiner*—Leslie Grohusky
*Attorney, Agent, or Firm*—Sughrue, Mion, Zinn, Macpeak & Seas, PLLC

[57] ABSTRACT

A thermal transfer printer having an improved structure to transport a recording paper and an ink ribbon by a capstan motor is provided. The printer includes a rotating shaft installed between frames, and in parallel with a capstan roller. A clutch mechanism is provided and includes an inner wheel member provided with a bushing and a cylindrical disk radially extended from one edge of the bushing. The inner wheel member is coupled to an end portion of the rotating shaft, and an outer wheel member is rotatably combined with the outer circumferential surface of the bushing of the inner wheel member and frictionally rotated against the capstan roller, such that when the capstan roller is rotated in one direction, both the inner and outer wheel members are rotated, while when the capstan roller is rotated in the reverse direction, only the outer wheel member is rotated. A take-up reel is coupled to the rotating shaft, for winding one end of the ink ribbon. A supply reel is rotatably installed on the frame, for winding the other end of the ink ribbon.

11 Claims, 8 Drawing Sheets

HEAT TRANSFER PRINTER

BACKGROUND OF THE INVENTION

The present invention relates to a thermal transfer printer and, more particularly, to a thermal transfer printer having an improved structure to allow a recording paper and an ink ribbon to be transported together by a capstan motor.

In a conventional thermal transfer printer, colored inks are sequentially printed one on top of the other by pressing the ink ribbon on a recording paper which is moved back and forth. As shown in FIGS. 1 and 2, in this conventional thermal transfer printer, an ink ribbon 26 is movably installed above a platen drum 15 which is rotatably installed on frames 1 and 2, and a recording head 20 is installed so that up and down movement on the upper part of the ink ribbon 26 is possible.

Colored inks such as yellow (Y), magenta (M), cyan (C), and black (B) are sequentially coated on the surface of the ink ribbon 26 which is wound between a supply reel 21 and a take-up reel 22. The take-up reel 22 is connected to a take-up motor 25 through connecting gears 23 and 24, and rotated by the take-up motor 25.

Also, a capstan roller 10 rotated by a capstan motor 17 and a pinch roller 11 rotated against the capstan roller 10 are rotatably installed in parallel with the platen drum 15.

In this case, if the capstan and pinch rollers 10 and 11 are rotated by the capstan motor 17 to feed the recording paper 16 to a printing position, the ink ribbon 26 is wound on the take-up reel 22 by the take-up motor 25. Then, the take-up motor 25 stops after being rotated by a predetermined number of steps. At this time, the yellow colored ink on the ink ribbon 26 is transferred to a predetermined position on the recording paper 16.

Next, the recording head 20 descends to thermally press the ink ribbon 26, thereby printing the yellow colored ink on the recording paper 16. Thereafter, the recording paper 16 is moved back and forth by the capstan roller 10 so that the magenta, cyan, and black colored inks are sequentially printed on the recording paper 16 in the same manner and position as the yellow. At this stage, while the inks are printed on the recording paper 16, the recording head 20 descends to press the ink ribbon 26; and while the recording paper 16 is moved to the printing position, the recording head 20 is in an ascending state.

However, in the conventional thermal transfer printer, since the capstan motor 17 and the take-up motor 25 are separately installed, the printer's structure is complicated and cost reduction is difficult.

SUMMARY OF THE INVENTION

To solve the above problems, it is an object of the present invention to provide a thermal transfer printer having an improved structure wherein a capstan roller and an ink ribbon are driven by a single driving source.

To accomplish the above object, there is provided a thermal transfer printer comprising: a pair of frames installed so as to be spaced apart from each other; a platen drum rotatably mounted between the frames; a capstan roller rotatably mounted parallel to the platen drum; a capstan motor which produces a driving force for driving the capstan roller; means for transporting a recording paper while contacting the capstan roller; an ink ribbon transportably installed above the platen drum, and having a surface sequentially coated with colored inks; means for transporting the ink ribbon by the driving force of the capstan motor; and a recording head, which is pivotally installed for up and down movement above the ink ribbon, for pressing the ink ribbon and the recording paper on the platen drum.

The ink ribbon transporting means comprises: a rotating shaft rotatably mounted between the frames, in parallel with the capstan roller, the rotating shaft having opposite end portions; clutch means having an inner wheel member provided with a bushing and a cylindrical disk radially extended from one edge of the bushing, the inner wheel member being combined with one end portion of the rotating shaft, and an outer wheel member rotatably combined with the circumferential surface of the bushing of the inner wheel member and frictionally rotated against the capstan roller, such that when the capstan roller is rotated in one direction, both of the inner and outer wheel members are rotated, while when the capstan roller is rotated in the reverse direction, only the outer wheel member is rotated; a take-up reel combined with the rotating shaft, for winding one end of the ink ribbon; and a supply reel rotatably installed on the frame, for winding the other end of the ink ribbon.

Preferably, a plurality of inclined grooves is formed on the inner circumferential surface of the outer wheel member, and a ball movably interposed between each of the inclined grooves and the bushing thereof, such that the balls may be interlocked between the outer wheel member and the bushing or may depart from being interlocked therebetween, depending on which direction the outer wheel member is rotated.

According to the above characteristics of the present invention, the thermal transfer printer has a simple structure, since the ink ribbon is transported by the rotating force of the capstan roller also used to transport a recording paper.

BRIEF DESCRIPTION OF THE DRAWINGS

The above object and advantages of the present invention will become more apparent by describing in detail a preferred embodiment thereof with reference to the accompanying drawings, in which.

DETAILED DESCRIPTION OF THE INVENTION

Figure 1:
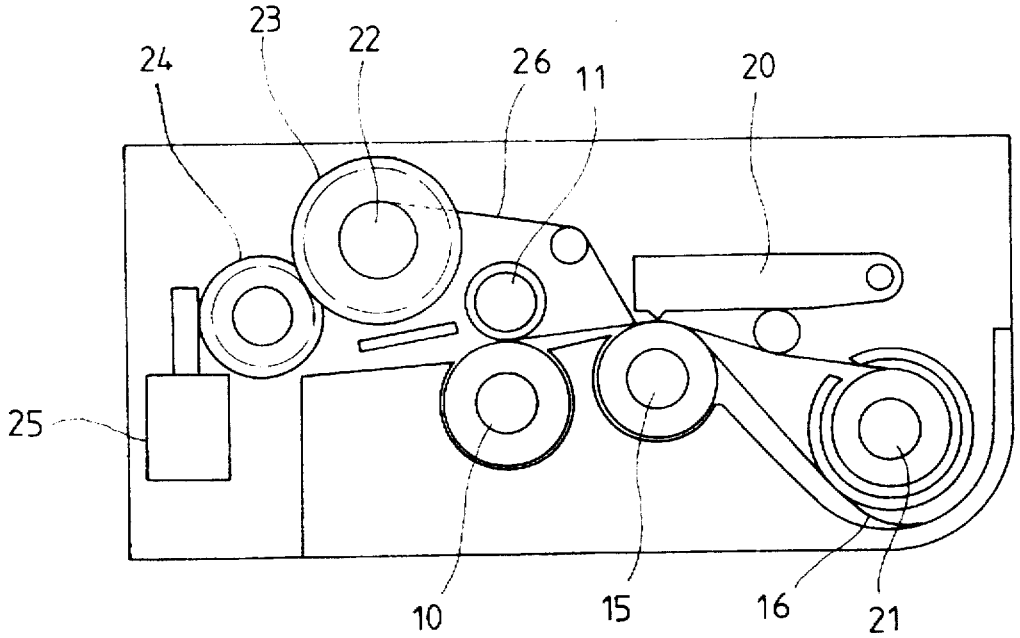
FIG. 1 (PRIOR ART)
FIG. 1 is a side view of a conventional thermal transfer printer.
Figure 2:
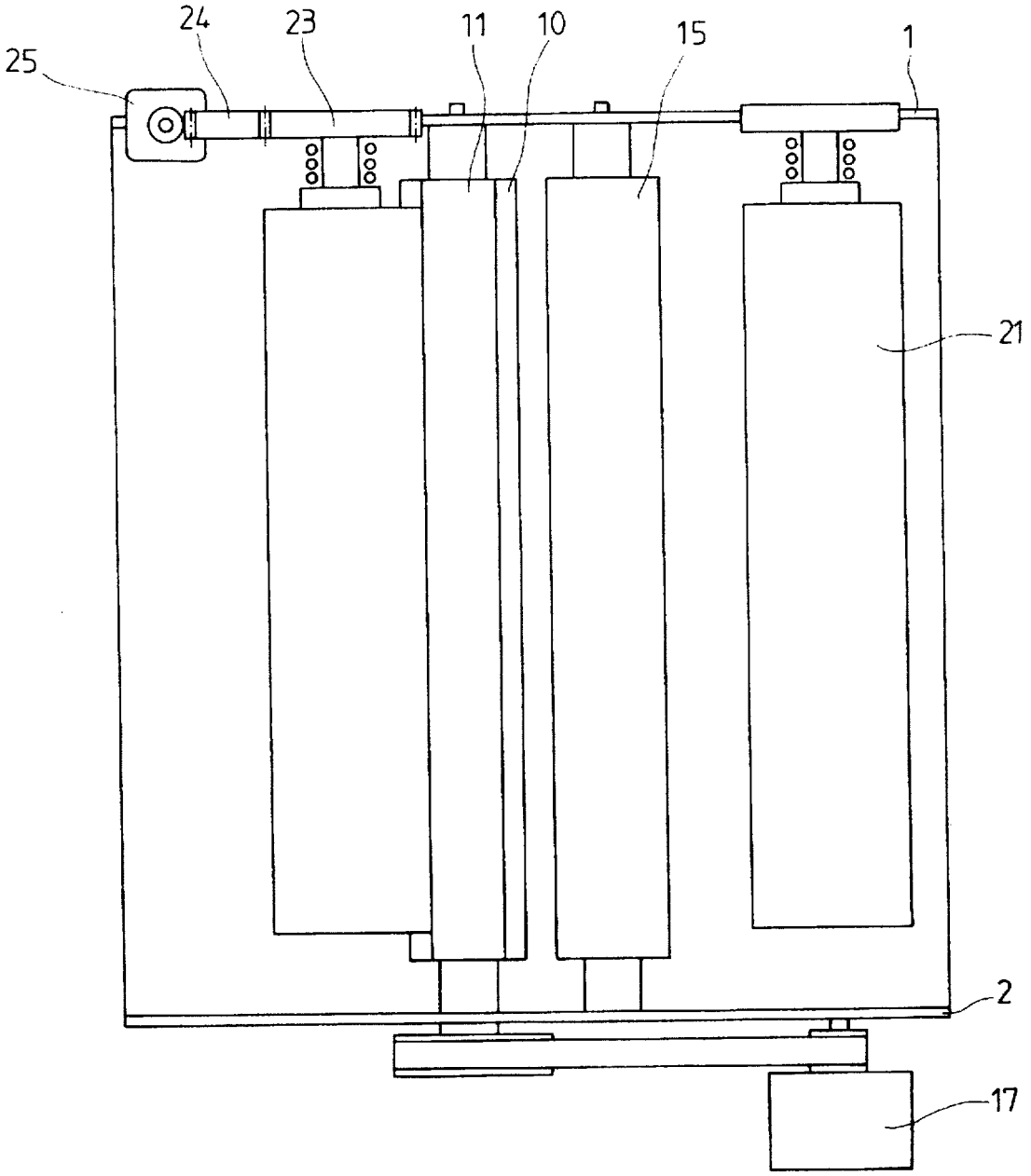
FIG. 2 (PRIOR ART)
FIG. 2 is a plan view of the conventional thermal transfer printer of FIG. 1.
Figure 3:
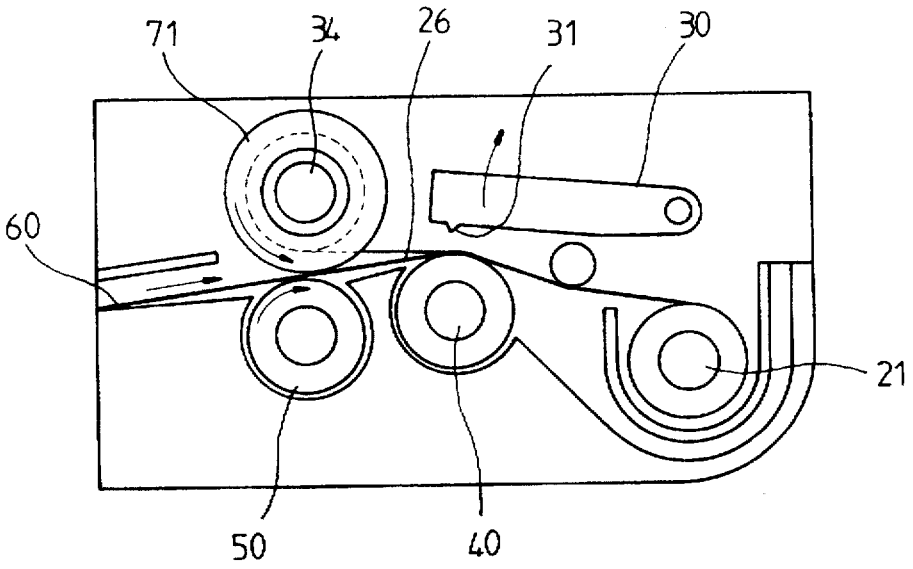
FIGS. 3 and 4 show the action of a thermal transfer printer according to the present invention.
Figure 5:
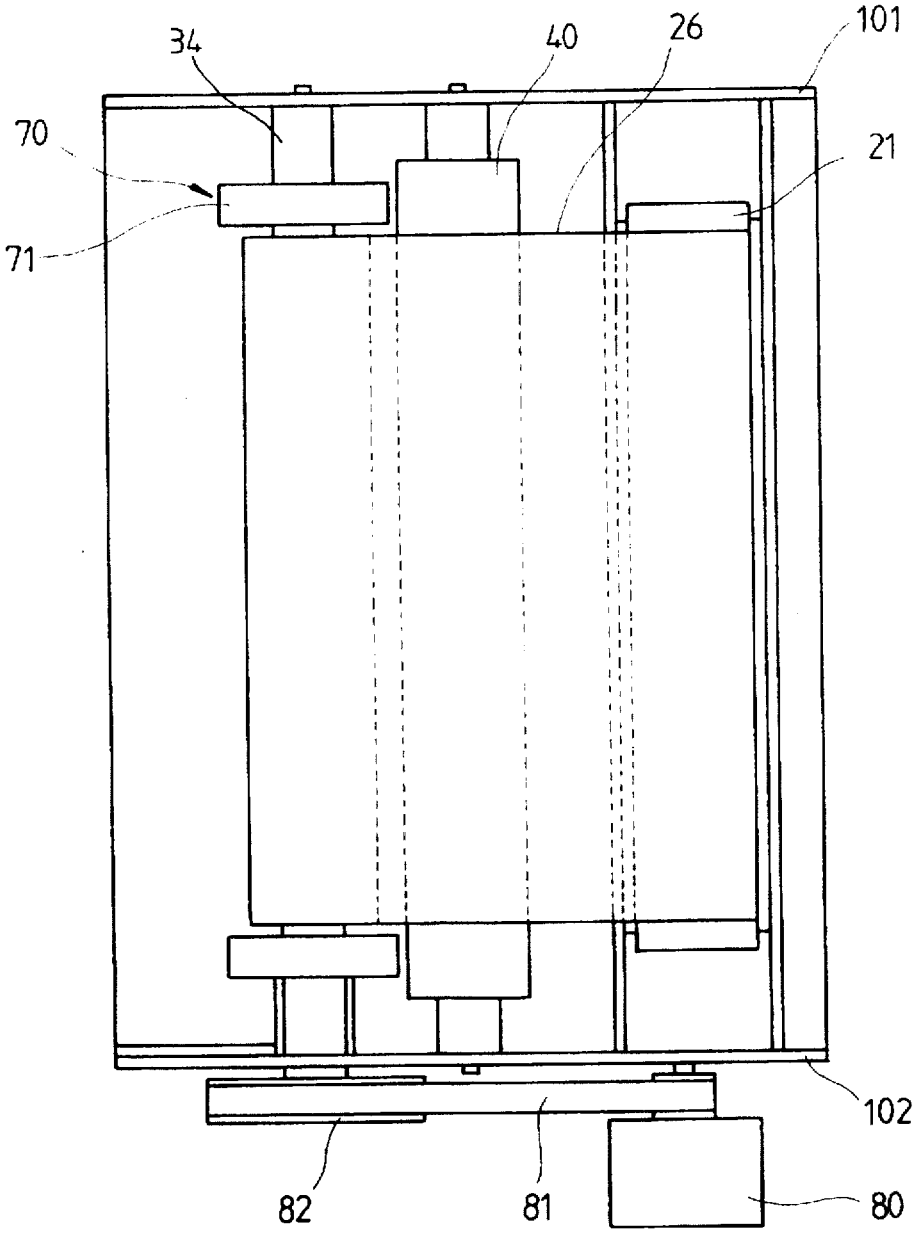
FIG. 5 is a plan view of the thermal transfer printer according to the present invention.
Figure 6:
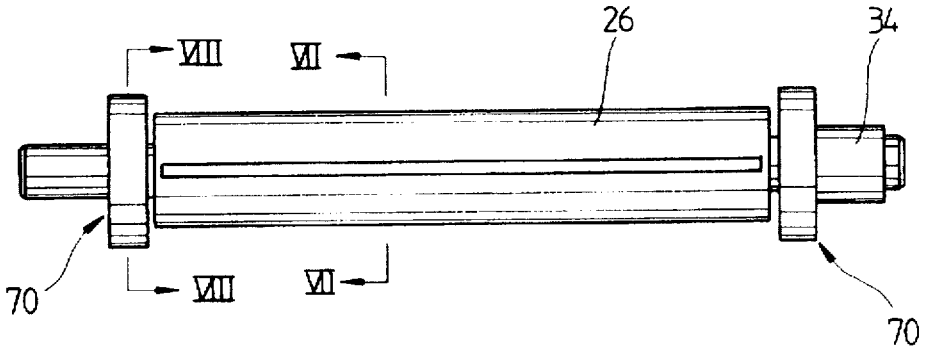
FIG. 6 is a schematic showing a take-up reel portion of the thermal transfer printer according to the present invention.
Figure 7:
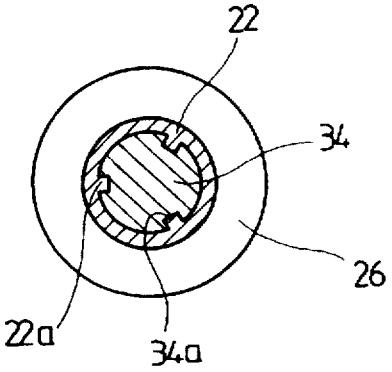
FIG. 7 is a sectional view taken along line VII—VII of FIG. 6.

Referring to FIGS. 3 and 5, a cylindrical platen drum 40 and a cylindrical capstan roller 50 are rotatably installed on a pair of frames 101 and 102 which are spaced apart from each other by a predetermined interval. Also, the capstan roller 50 is rotated by a capstan motor 80. Reference numeral 82 denotes a pulley combined with one end of the capstan roller 50, and reference numeral 81 denotes a belt member for connecting the capstan motor 80 to the pulley 82.

An ink ribbon 26 is transportably installed above the platen drum 40. The surface of the ink ribbon 26 is sequentially coated with yellow, magenta, cyan, and black colored inks. A recording head 30 is pivotally installed so that up and down movement above the ink ribbon 26 is possible. The recording head 30 descends to thermally press the ink ribbon 26 and recording paper 60 on the platen drum 40. The recording head 30 includes a heating element 31 heated by a predetermined heating means.

Meanwhile, the present invention characteristically includes means for transporting the ink ribbon 26 and the recording paper 60 by the driving force of the capstan motor 80.

Referring to FIGS. 3 and 6–9, the transporting means includes a rotating shaft 34 parallel with the capstan roller 50, rotatably installed on the frames 101 and 102. An overrunning clutch assembly 70 having an inner wheel member 72 (see FIG. 9) is provided with a bushing **72*a* and a cylindrical disk 72*b* radially extended from one edge of the bushing 72*a*. The inner wheel member is tightly seated on the end portion of the rotating shaft 34, and an outer wheel member 71 is rotatably combined with the outer circumferential surface of the bushing 72*a* of the inner wheel member 72 and frictionally rotated against the capstan roller 50. A take-up reel 22 (see FIG. 7) is combined with the rotating shaft 34, for winding one end of the ink ribbon 26; and a supply reel 21 (see FIG. 5) is rotatably installed on the frames 101 and 102, for winding the other end of the ink ribbon 26. In this case, when the capstan roller 50 rotates in one direction, both the inner and outer wheel members 72 and 71 are rotated; but, when it rotates in the reverse direction, only the outer wheel member 71 is rotated. As is evident from FIG. 6, an overrunning clutch assembly 70, as shown and described with respect to FIG. 9, may be provided at both end portions of the rotating shaft 34**.

A plurality of grooves **34*a* (refer to FIG. 7) are formed inwardly on the outer circumferential surface of the rotating shaft 34. Also, a plurality of coupling protrusions 22*a* are formed on the inner circumferential surface of the take-up reel 22 to be inserted into the respective grooves 34*a***.

Figure 8A:
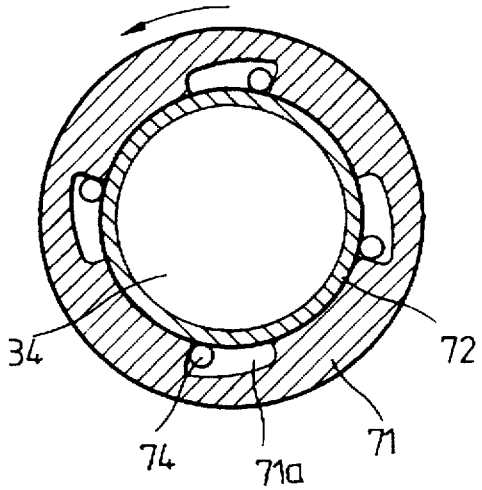
FIGS. 8A and 8B are sectional views taken along line VIII—VIII of FIG. 6, showing the state of a ball's position according to the rotating direction of an outer wheel member.
Figure 8B:
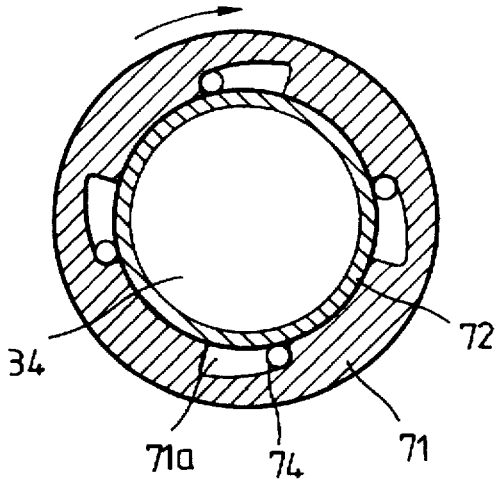
Figure 9:
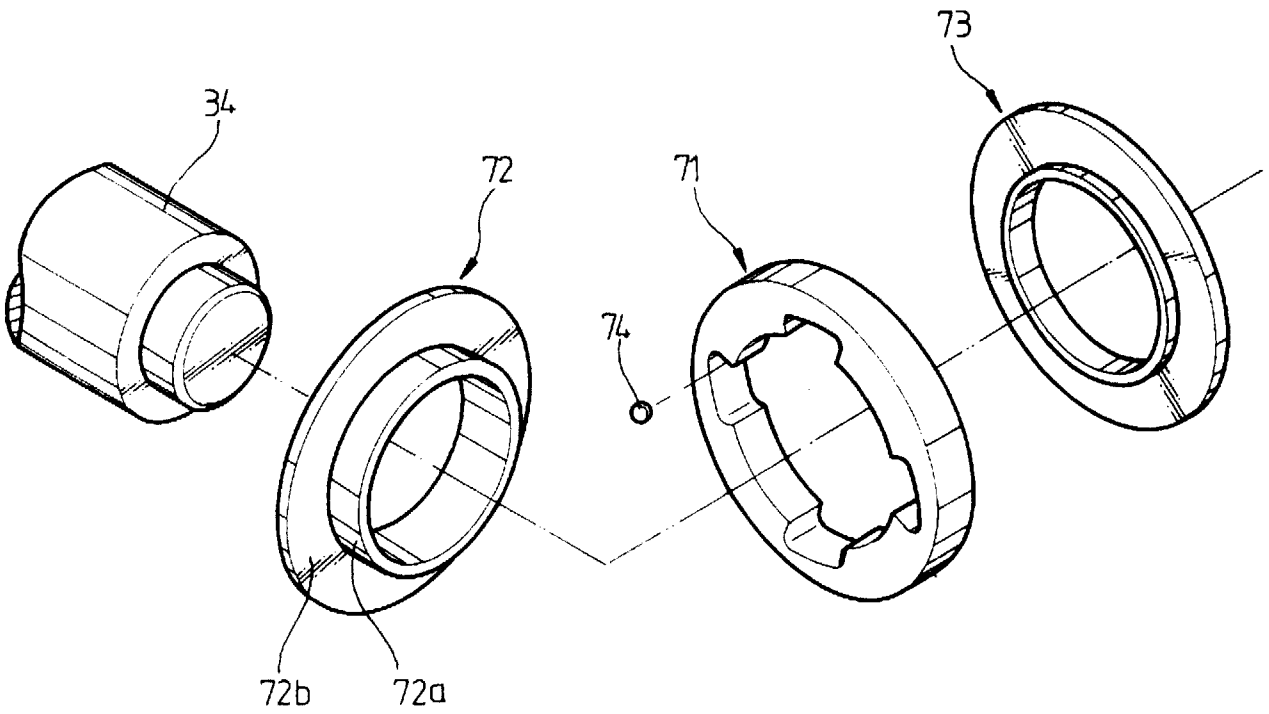
FIG. 9 is an exploded perspective view showing the essential parts of the thermal transfer printer according to the present invention.

Referring to FIGS. 8A, 8B, and 9, in the overrunning clutch 70, a plurality of inclined grooves **71*a* are formed on the inner circumferential surface of the outer wheel member 71, and a ball 74 is movably interposed in a space between each of the inclined grooves 71*a* and the bushing 72*a*. Accordingly, the balls 74 may be interlocked between the outer wheel member 71 and the bushing 72*a* or may depart from being interlocked therebetween by being moved in the inclined grooves 71*a*, depending on the rotating direction of the outer wheel member 71. That is, as shown in FIG. 8A, if the outer wheel member 71 is rotated counterclockwise by the clockwise motion of the capstan roller 50, each ball 74 moves to a broad portion (right side) of the corresponding inclined groove 71*a*. That is, the balls 74 depart from being interlocked between the outer wheel member 71 and the bushing 72*a*, so that the rotating force of the outer wheel member 71 is not transmitted to the inner wheel member 72. Thus, the inner wheel member 72** does not rotate.

Also, a cover member 73 is tightly seated on the rotating shaft 34 to prevent the departure of the outer wheel member 71 from the inner wheel member 72 (see FIG. 9).

The thermal transfer printer having such a configuration according to the present invention will be operated as follows.

First, referring to FIG. 3 showing a paper supplying state, if the capstan roller 50 is rotated clockwise by the capstan motor 80, the outer wheel member 71 is rotated counterclockwise. At this time, the recording paper 60 is fed to the printing position by the pressure of the capstan roller 50 against the outer wheel member 71.

As shown in FIG. 8A, if the outer wheel member 71 is rotated counterclockwise, the balls 74 are moved to a large portion of the inclined grooves **71*a* and thus depart from being interlocked between the outer wheel member 71 and the bushing 72*a*. Thus, the inner wheel member 72, rotating shaft 34, and take-up reel 22 do not rotate. Therefore, the ink ribbon 26 is not wound to the take-up reel 22**.

Figure 4:
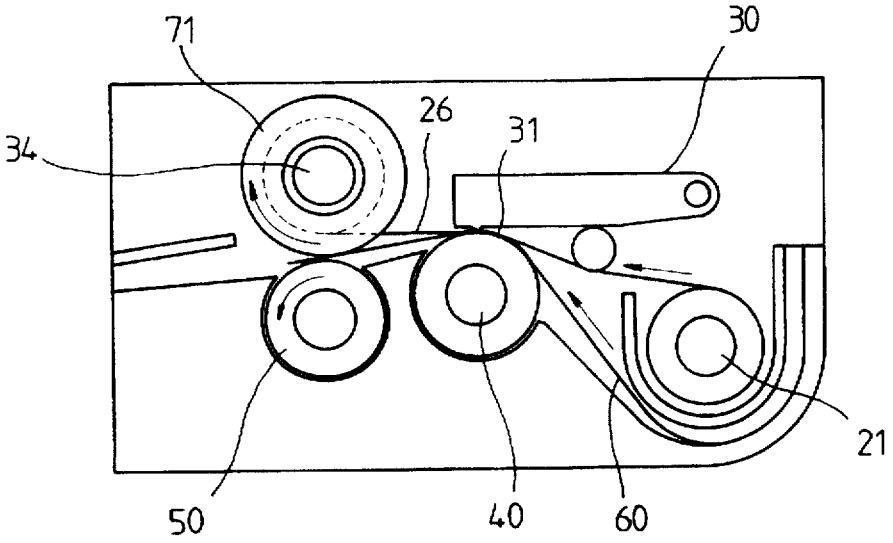

As shown in FIG. 4, the recording paper 60 is transported to the printing position, and then the recording head 30 descends to press the ink ribbon 26 and the recording paper 60 on the platen drum 40. Also, the heating element 31 radiates heat in a predetermined pattern according to a recording signal, and simultaneously the capstan motor 80 is operated in a reverse direction. Thus, the capstan roller 50 is rotated counterclockwise and the outer wheel member 71 is rotated clockwise, thereby transporting the recording paper 60. At this stage, as shown in FIG. 8B, if the outer wheel member 71 is rotated clockwise, the balls 74 are moved to the narrow portion (left side) of the inclined grooves **71*a*. At this time, the balls 74 are interlocked between the outer wheel member 72 and the bushing 72*a*, so that the rotating force of the outer wheel member 71 is transmitted to the inner wheel member 72 and, in turn, the rotating shaft 34. Accordingly, the inner wheel member 72, rotating shaft 34, and take-up reel 22 are all rotated clockwise together with the outer wheel member 71, whereby the ink ribbon 26 is wound onto the take-up reel 22**.

As described above, the recording paper 60 and ink ribbon 26 are transported together, and the yellow colored ink on the ink ribbon 26 is printed on the recording paper 60.

After printing the yellow colored ink, the recording paper 60 is again transported to the printing position. At this time, the operating state of the printer is as shown in FIG. 3.

In the same manner, the magenta, cyan, and black colored inks are sequentially printed over top of the yellow colored ink.

In the thermal transfer printer, the recording paper 60 and the ink ribbon 26 are transported together upon printing, but the ink ribbon 26 is in a pause state when the recording paper 60 is transported to the printing position.

As described above, the thermal transfer printer according to the present invention can transport the recording paper 60 and ink ribbon 26 together by the capstan motor 80 without using a take-up motor. Therefore, the structure of the thermal transfer printer is simplified, and a cost reduction thereof is possible.

It is contemplated that numerous modifications may be made to the heat transfer printer of the present invention without departing from the spirit and scope of the invention as defined in the following claims.

What is claimed is:

1. A thermal transfer printer comprising:

a pair of frames installed so as to be spaced apart from each other;

a platen drum rotatably mounted between said frames;

a capstan roller rotatably mounted parallel to said platen drum;

a capstan motor which produces a driving force for driving said capstan roller, an output of said capstan motor being drivingly connected to said capstan roller;

means for transporting a recording paper while contacting said capstan roller;

an ink ribbon transportably installed above said platen drum, and having a surface sequentially coated with colored inks;

means for transporting said ink ribbon by the driving force of said capstan motor; and a recording head, which is pivotally installed for up and down movement above said ink ribbon, for pressing said ink ribbon and the recording paper on said platen drum.

2. The thermal transfer printer as claimed in claim 1, wherein said recording paper transporting means comprises:

a rotating shaft mounted between said frames, in parallel with said capstan roller, said rotating shaft having opposite end portions;

clutch means including an inner wheel member provided with a bushing and a cylindrical disk radially extended from one edge of said bushing, said inner wheel member being combined with one end portion of said rotating shaft, and an outer wheel member rotatably combined with the circumferential surface of said bushing of said inner wheel member and frictionally rotated against said capstan roller, so that when said capstan roller is rotated in one direction, both of said inner and outer wheel members are rotated, while when said capstan roller is rotated in a reverse direction, only said outer wheel member is rotated.

3. The thermal transfer printer as claimed in claim 2, wherein a plurality of inclined grooves is formed on an inner circumferential surface of said outer wheel member, and a ball is movably interposed between each of said inclined grooves and said bushing, such that, depending on a rotating direction of said outer wheel member, said balls are either interlocked between said outer wheel member and said bushing or depart from being interlocked therebetween.

4. The thermal transfer printer as claimed in claim 2, wherein said clutch means further comprises another inner wheel member/outer wheel member combination disposed with respect to the other end portion of said rotating shaft.

5. The thermal transfer printer as claimed in claim 3, wherein a cover member is installed on the one end portion of said rotating shaft to prevent departure of said outer wheel member from said inner wheel member.

6. The thermal transfer printer as claimed in claim 1, wherein said ink ribbon transporting means comprises:

a rotating shaft rotatably mounted between said frames, in parallel with said capstan roller, said rotating shaft having opposite end portions;

clutch means including an inner wheel member provided with a bushing and a cylindrical disk radially extended from one edge of said bushing, said inner wheel member being combined with one end portion of said rotating shaft, and an outer wheel member rotatably combined with the circumferential surface of said bushing of said inner wheel member and frictionally rotated against said capstan roller, such that when said capstan roller is rotated in one direction, both of said inner and outer wheel members are rotated, while when said capstan roller is rotated in a reverse direction, only said outer wheel member is rotated;

a take-up reel combined with said rotating shaft, for winding one end of said ink ribbon; and a supply reel rotatably installed on said frames, for winding the other end of said ink ribbon.

7. The thermal transfer printer as claimed in claim 6, wherein a plurality of inclined grooves is formed on an inner circumferential surface of said outer wheel member, and a ball is movably interposed between each of said inclined grooves and said bushing, such that, depending on a rotating direction of said outer wheel member, said balls are either interlocked between said outer wheel member and said bushing or depart from being interlocked therebetween.

8. The thermal transfer printer as claimed in claim 7, wherein a cover member is installed on the one end portion of said rotating shaft to prevent departure of said outer wheel member from said inner wheel member.

9. The thermal transfer printer as claimed in claim 6, wherein said clutch means further comprises another inner wheel member/outer wheel member combination disposed with respect to the other end portion of said rotating shaft.

10. A thermal transfer printer comprising:

a pair of frames installed so as to be spaced apart from each other;

a platen drum rotatably mounted between said frames;

a capstan roller rotatably mounted parallel to said platen drum;

a capstan motor which produces a driving force for driving said capstan roller;

a recording paper transporting mechanism comprising:

a rotating shaft mounted between said frames, in parallel with said capstan roller, said rotating shaft having opposite end portions; and a clutch mechanism including an inner wheel member provided with a bushing and a cylindrical disk radially extended from one edge of said bushing, said inner wheel member being combined with one end portion of said rotating shaft, and an outer wheel member rotatably combined with the circumferential surface of said bushing of said inner wheel member and frictionally rotated against said capstan roller, so that when said capstan roller is rotated in one direction, both of said inner and outer wheel members are rotated, while when said capstan roller is rotated in a reverse direction, only said outer wheel member is rotated, thereby for transporting a recording paper while contacting said capstan roller;

an ink ribbon transportably installed above said platen drum, and having a surface sequentially coated with colored inks;

an ink ribbon transporting mechanism which transports said ink ribbon by the driving force of said capstan motor; and a recording head, which is pivotally installed for up and down movement above said ink ribbon, for pressing said ink ribbon and the recording paper on said platen drum.

11. A thermal transfer printer comprising:

a pair of frames installed so as to be spaced apart from each other;

a platen drum rotatably mounted between said frames;

a capstan roller rotatably mounted parallel to said platen drum;

a capstan motor which produces a driving force for driving said capstan roller;

a recording paper transporting mechanism which transports a recording paper while contacting said capstan roller;

an ink ribbon transportably installed above said platen drum, and having a surface sequentially coated with colored inks;

an ink ribbon transporting mechanism comprising:

a rotating shaft rotatably mounted between said frames, in parallel with said capstan roller, said rotating shaft having opposite end portions;

a clutch mechanism including an inner wheel member provided with a bushing and a cylindrical disk radially extended from one edge of said bushing, said inner wheel member being combined with one end portion of said rotating shaft, and an outer wheel member rotatably combined with the circumferential surface of said bushing of said inner wheel member and frictionally rotated against said capstan roller, such that when said capstan roller is rotated in one direction, both of said inner and outer wheel members are rotated, while when said capstan roller is rotated in a reverse direction, only said outer wheel member is rotated;

a take-up reel combined with said rotating shaft, for winding one end of said ink ribbon; and a supply reel rotatably installed on said frames, for winding the other end of said ink ribbon, thereby for transporting said ink ribbon by the driving force of said capstan motor; and a recording head, which is pivotally installed for up and down movement above said ink ribbon, for pressing said ink ribbon and the recording paper on said platen drum.

* * * * *